United States Patent [19]

Shiembob

[11] 4,433,845

[45] Feb. 28, 1984

[54] INSULATED HONEYCOMB SEAL

[75] Inventor: Lawrence T. Shiembob, Rocky Hill, Conn.

[73] Assignee: United Technologies Corporation, Hartford, Conn.

[21] Appl. No.: 306,838

[22] Filed: Sep. 29, 1981

[51] Int. Cl.[3] ..... F16J 15/40

[52] U.S. Cl. ..... 277/1; 277/53; 277/227; 415/174; 427/423

[58] Field of Search ..... 277/53, 1; 415/174, 415/177; 427/423, 34

[56] References Cited

U.S. PATENT DOCUMENTS

| | | | |
|---|---|---|---|
| 3,042,365 | 7/1962 | Curtis et al. | 277/53 |
| 3,720,419 | 3/1973 | Adelizzi | 277/53 |
| 3,834,001 | 9/1974 | Carroll et al. | 277/1 |
| 4,336,276 | 6/1982 | Bill et al. | 415/174 |

*Primary Examiner*—Robert I. Smith

*Attorney, Agent, or Firm*—Charles A. Warren

[57] ABSTRACT

The application discloses the manufacture of a seal for a row of turbine blades in which the seal is a honeycmb seal and a layer of insulation is positioned in the cells of the honeycomb by flame spraying. A process for accomplishing the deposition of the insulation is also described.

6 Claims, 3 Drawing Figures

INSULATED HONEYCOMB SEAL

DESCRIPTION

1. Technical Field

This invention relates to honeycomb type of seals for gas turbine engines in which the seal that surrounds a row of blades in the engine is at least partially filled with an insulating material to reduce the thermal gradients in the turbine case and thus minimize contact between the blades and the seal.

2. Background Art

To reduce the gas path seal clearances during engine transients attempts have been made to insulate the seals and their supports to reduce the thermal response of the parts. Where the seal is a honeycombed material the honeycomb has been filled with a paste form of insulation which is then brazed or sintered to set and bond the material. This procedure is difficult to monitor to assure a uniform filling of the honeycomb with the result that there is uneven insulation throughout the honeycomb. When it is desirably only to partially fill the honeycomb in certain installations, a uniform filling to the extent desired is even more difficult.

DISCLOSURE OF INVENTION

One feature of the invention is the application of the coating of the insulating material as a powder by flame spraying this powder to the desired depth of thickness in the cells of the seal. Another feature is the use of a NiCrAl/bentonite powder as the insulating material. Another feature is the use of this powder in flame spraying applications which provide the desired bond and insulating properties as well as the desired hardness of the coating.

According to the invention a suitable insulating poweder is deposited to the desired depth or thickness in the honeycomb seal by flame spraying the powder into the cell structure of the honeycomb. The desired insulating powder is a NiCrAl/bentonite powder in which the particles consist of a bentonite core coated with a mixture of NiCrAl. The principal feature of the invention is the application of an insulating powder to the cells of a honeycomb by a flame spraying procedure by which to assure a uniform application of the insulating coating to the desired depth in the honeycomb and to produce an insulating structure that has the desired characteristics without further treatment beyond the flame spraying.

The foregoing and other objects, features and advantages of the present invention will become more apparent in the light of the following detailed description of the preferred embodiment thereof as shown in the accompanying drawing.

BEST MODE FOR CARRYING OUT THE INVENTION

Figure 1:
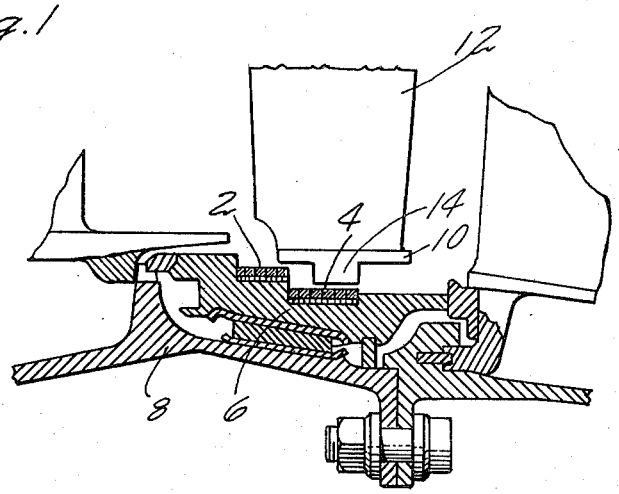
FIG. 1 is a fragmentary sectional view through a turbine showing the location of the honeycomb seal.
Figure 3:
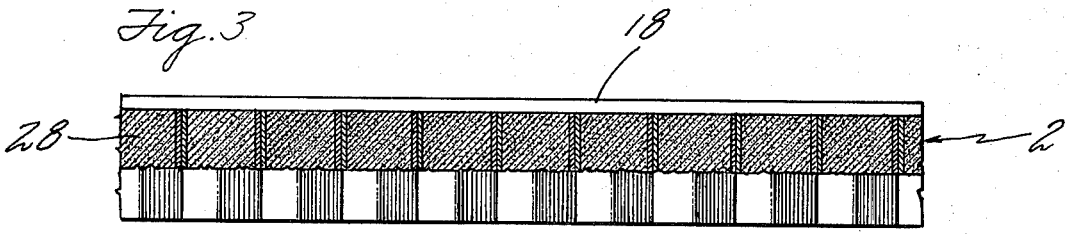
FIG. 3 is an enlarged sectional view of the seal.

Referring to FIG. 1 the honeycomb seals 2 and 4 are shown as supported by a seal ring 6 positioned within the turbine casing 8. The seal 2 has a smaller diameter than the seal 4 and engages the shrouds 10 of the turbine blade 12 adjacent to the leading edges of these shrouds. The seal 4 has a larger diameter and surrounds and is closely adjacent to a central rib 14 on the shrouds. Desirably the seals have a minimum of clearance with the shrouds to reduce the leakage of gas past the seals and the honeycomb material is selected as a seal since it will wear away readily in the event of contact with the blade shrouds during engine transients without any detrimental effect on the turbine.

It is desirable to reduce the heat transfer from the gas going through the turbine to the seals thereby reducing the rate of change in diameter of the seals during engine transients. As above stated this has been done by manually packing an insulating material in paste form into the honeycomb seals. Such a procedure is time consuming and does not result in a uniform distribution of the paste in the openings of the seal particularly, if the seal openings are to be only partially filled. To provide a better and more dependable insulation it has been found that suitable insulating powders may be flame sprayed into the seal and will produce the desired uniform insulating effect with the desired depth of insulation in the honeycomb spaces or cells. Further the flame spraying produces a better adherence of the insulating material with more uniform insulating properties. The material is also cured to the desired hardness by the flame spraying thereby avoiding any further heat treatment of the seal with the insulation therein.

Figure 2:
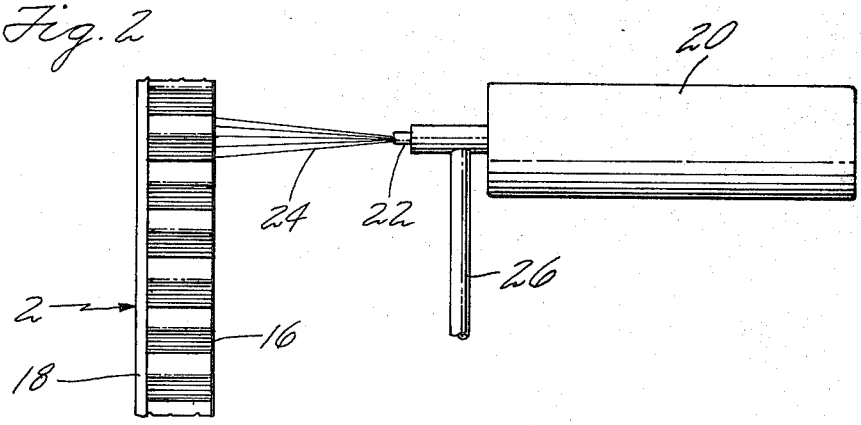
FIG. 2 is an enlarged sectional view showing the coating applied to the seal.

Referring now to FIG. 2 the seal 2 being honeycomb has openings or spaces 16 therein extending radially and the outer ends of these spaces or cells are closed by the surrounding seal ring 18. To accomplish the desired insulation of this seal a suitable insulating powder having desired insulating characteristics is flame sprayed into the spaces or cells to the desired length. In the particular seal shown the cell dimension is one-sixteenth inch and the height of the honeycomb is 0.100 inch. The powder is flame sprayed into the cells to provide insulation 28 to a depth of $0.050 \pm 0.020$ inch within the cell. It will be understood that these dimensions are given by way of example and the cell size or depth of insulation are not critical to the invention.

The preferred powder consists of particles of bentonite which is normally 70% $SiO_2$ and 20% $Al_2O_3$ by weight and these particles are coated with a mixture of NiCrAl to produce a composition in the powder of chromium 1.5 to 6.5%, aluminum 1.0 to 6.0%, bentonite 18 to 24%, nickel remainder. It will be understood that any insulating powder capable of being applied by flame spraying may be used instead of this particular powder although it is known that this particular powder produces a very satisfactory insulating coating. The seals are preferably cleaned before flame spraying to assure a cool bond with the insulating material and the powder is then sprayed in with conventional spray equipment capable of producing the desired coating density.

The insulating powder may be sprayed on, for example, by a flame sprayer 20 having a nozzle 22 discharging a flame 24 against the seal. The powder is applied by a tube 26 delivered through the nozzle to enter the flame and be deposited on the seal. The nozzle is moved axially relative to the seal and parallel to the surface thereof while the part is rotating for depositing the material. The nozzle is also desirably reciprocated axially past the seal during the circumferential movement to assure a uniform deposit in all of the cells of the seal. The normal flame spray deposition covers a relatively small area and would not normally be wide enough to fill the cells across the entire width of the seal without this axial movement. The insulation 28 is shown as applied only from the bottom of the cell up to the desired depth. It has been found that by flame spraying in the manner described substantially none of the insulating powder adheres to the side walls of the seal between the insulation and the open end of the seal.

One critical time in turbine operation is during deceleration when the cooler gas passing over the seals and the support structure causes these structures to shrink more rapidly than the rotor with the possibility of seal and shroud contact. This particular arrangement of insulation reduces the rate of shrinking of the seal to avoid this seal and shroud contact. Since engine clearances are set for this condition the use of this insulation enables a reduction in the engine design clearances at this point and the result is a higher performance engine because of reduced leakage past the seal.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. In the manufacture of a seal for a row of turbine blades the steps of:

providing a honeycomb seal with the cells therein substantially radial;

closing the outer ends of the cells by a surrounding ring; and flame spraying an insulating material into the cells to fill at least partially the cells radially inward from the outer ends, the insulating material being clay particles with an alloy coating and curing this material to the desired hardness by the heat of the flame spraying.

2. The process of claim 1 including the step of using as the insulating material to be flame sprayed a powder in which the particles are NiCrAl/bentonite.

3. The process of claim 1 in which the particles are in the form of a core or bentonite with a NiCrAl coating thereon.

4. A turbine seal for a row of turbine blades including:

a honeycomb seal ring in which the cells of the honeycomb extend radially;

a surrounding ring closing the outer ends of the cells; and an insulating material positioned in said cells by flame spraying an insulating powder into said cells in which the insulating material is a clay base combined with a metallic alloy, that is heat cured to the desired hardness in the flame spraying operation.

5. A turbine seal as in claim 4 in which the material that is flame sprayed is in the form of particles having a bentonite core and NiCrAl coating.

6. A turbine seal as in claim 4 in which the insulating material is NiCrAl/bentonite.

* * * * *